US008305327B2

(12) United States Patent
Aoki et al.

(10) Patent No.: US 8,305,327 B2
(45) Date of Patent: Nov. 6, 2012

(54) DISPLAY DEVICE CAPABLE OF REDUCING VOLTAGES IN EXTERNAL INTEGRATED CIRCUIT

(75) Inventors: Yoshiro Aoki, Kitamoto (JP); Takanori Tsunashima, Fukaya (JP)

(73) Assignee: Toshiba Manufacturing Display Technology Co., Ltd., Tokyo (JP)

( * ) Notice: Subject to any disclaimer, the term of this patent is extended or adjusted under 35 U.S.C. 154(b) by 769 days.

(21) Appl. No.: 12/468,409

(22) Filed: May 19, 2009

(65) Prior Publication Data

US 2009/0289888 A1 Nov. 26, 2009

(30) Foreign Application Priority Data

May 20, 2008 (JP) ..... 2008-131818

(51) Int. Cl.
*G09G 3/36* (2006.01)

(52) U.S. Cl. ..... 345/100; 345/98
(58) Field of Classification Search ..... None
See application file for complete search history.

(56) References Cited

U.S. PATENT DOCUMENTS

2006/0119563 A1 * 6/2006 Nakamura et al. ..... 345/98

FOREIGN PATENT DOCUMENTS

JP 2001-109435 4/2001

* cited by examiner

*Primary Examiner* — Alexander Eisen
*Assistant Examiner* — Kirk Hermann
(74) *Attorney, Agent, or Firm* — Finnegan, Henderson, Farabow, Garrett & Dunner, L.L.P.

(57) ABSTRACT

Provided is a waveform processing circuit including: an amplitude expansion circuit configured to expand amplitude of an analog video signal; a voltage shifting circuit configured to shift a voltage of the analog video signal; and an impedance conversion circuit having an output impedance lower than that of the voltage shifting circuit.

3 Claims, 19 Drawing Sheets

POSITIVE POLARITY CIRCUIT 33P

POSITIVE POLARITY CIRCUIT 33P / FROM 3.3 V TO 10 V / BLACK DISPLAY
(FIRST STEP)

POSITIVE POLARITY CIRCUIT 33P / FROM 3.3 V TO 10 V / BLACK DISPLAY
(SECOND STEP)

POSITIVE POLARITY CIRCUIT 33P / FROM 3.3 V TO 10 V / BLACK DISPLAY
(THIRD STEP)

POSITIVE POLARITY CIRCUIT 33P / FROM 3.3 V TO 10 V / BLACK DISPLAY
(FOURTH STEP)

POSITIVE POLARITY CIRCUIT 33P / FROM 0 V TO 5 V / WHITE DISPLAY
(FIRST STEP)

POSITIVE POLARITY CIRCUIT 33P / FROM 0 V TO 5 V / WHITE DISPLAY
(SECOND STEP)

POSITIVE POLARITY CIRCUIT 33P / FROM 0 V TO 5 V / WHITE DISPLAY (THIRD STEP)

POSITIVE POLARITY CIRCUIT 33P / FROM 0 V TO 5 V / WHITE DISPLAY
(FOURTH STEP)

NEGATIVE POLARITY CIRCUIT 33N

NEGATIVE POLARITY CIRCUIT 33N / FROM 3.3 V TO 5 V / WHITE DISPLAY
(FIRST STEP)

NEGATIVE POLARITY CIRCUIT 33N / FROM 3.3 V TO 5 V / WHITE DISPLAY
(SECOND STEP)

NEGATIVE POLARITY CIRCUIT 33N / FROM 3.3 V TO 5 V / WHITE DISPLAY
(THIRD STEP)

NEGATIVE POLARITY CIRCUIT 33N / FROM 3.3 V TO 5 V / WHITE DISPLAY
(FOURTH STEP)

NEGATIVE POLARITY CIRCUIT 33N / FROM 0 V TO 0 V / BLACK DISPLAY
(FIRST STEP)

NEGATIVE POLARITY CIRCUIT 33N / FROM 0V TO 0 V / BLACK DISPLAY
(SECOND STEP)

NEGATIVE POLARITY CIRCUIT 33N / FROM 0 V TO 0 V / BLACK DISPLAY
(THIRD STEP)

NEGATIVE POLARITY CIRCUIT 33N / FROM 0 V TO 0 V / BLACK DISPLAY
(FOURTH STEP)

DISPLAY DEVICE CAPABLE OF REDUCING VOLTAGES IN EXTERNAL INTEGRATED CIRCUIT

CROSS-REFERENCE TO RELATED APPLICATIONS

This application is based upon and claims the benefit of priority from Japanese Patent Application No. 2008-131818 filed on May 20, 2008 the entire contents of which are incorporated herein by reference.

BACKGROUND OF THE INVENTION

1. Field of the Invention

The present invention relates to a display device that is capable of reducing voltages in an external integrated circuit (IC) serving as a source for supplying analog video signals.

2. Description of the Related Art

For example, when so-called HV inversion driving is performed for the purpose of improving image quality, in a liquid crystal display device, positive and negative polarity analog video signals need to be applied to pixels. The maximum amplitude value of such an analog video signal must be increased up to about 10 volts (V), for example. For this reason, it is difficult to reduce voltages in an external IC. As a result, it is hard to achieve low power consumption of an external IC as well as cost reduction and miniaturization of an internal circuit pattern.

SUMMARY OF THE INVENTION

The present invention has been made in view of the above problem. An object of the present invention is to provide a display device capable of reducing voltages in an external integrated circuit serving as a source for supplying analog video signals.

A display device according to a first aspect of the present invention includes: an array substrate; signal lines and scanning lines formed on the array substrate, the signal lines and the scanning lines intersecting with each other; a pixel formed at each intersection of the signal line and the scanning line; an amplitude expansion circuit formed for each signal line on the array substrate and configured to expand amplitude of an inputted analog video signal; a voltage shifting circuit formed for each amplitude expansion circuit on the array substrate and configured to shift a voltage of an analog video signal outputted from the amplitude expansion circuit; and an impedance conversion circuit formed for each voltage shifting circuit on the array substrate, the impedance conversion circuit having an output impedance lower than that of the voltage shifting circuit and configured to output, to the corresponding signal line, an analog video signal having the same voltage as that of the analog video signal outputted from the voltage shifting circuit.

The display device according to the first aspect of the present invention is capable of expanding amplitude of the analog video signal by including the amplitude expansion circuit, the voltage shifting circuit, and the impedance conversion circuit on the array substrate. Thus, it is possible to reduce voltages in an external integrated circuit that is a source for supplying the analog video signal.

A second aspect of the present invention provides the display device, according to the first aspect of the present invention, in which each amplitude expansion circuit includes: a first capacitor; a second capacitor having one electrode grounded; a first switch configured to open and close between the other electrode of the second capacitor and an input circuit node of the analog video signal; a second switch configured to open and close between one electrode of the first capacitor and the ground; a third switch configured to open and close between the one electrode of the first capacitor and the other electrode of the second capacitor; a fourth switch configured to open and close between the other electrode of the first capacitor and the other electrode of the second capacitor; and a fifth switch configured to open and close between the other electrode of the first capacitor and an output circuit node of the amplitude expansion circuit.

In the second aspect of the present invention, in the first step, only the first, the second, the fourth, and the fifth switches are turned on; in the second step, only the third and the fifth switches are turned on; in the third and the fourth steps, only the third switch is turned on.

A third aspect of the present invention provides the display device, according to a first aspect of the present invention, in which each voltage shifting circuit includes: a first capacitor having one electrode connected to an output circuit node of the amplitude expansion circuit; a second capacitor having one electrode connected to an output circuit node of the voltage shifting circuit; a first switch configured to open and close between the other electrode of the first capacitor and a reference point to which a predetermined reference voltage is supplied; a second switch configured to open and close between the other electrode of the second capacitor and the reference point or a reference point to which a different reference voltage is supplied; and a third switch configured to open and close between the other electrode of the first capacitor and the other electrode of the second capacitor.

In the third aspect of the present invention, in the first step, only the first and the second switches are turned on; also in the second step, only the first and the second switches are turned on; in the third step, only the second and the third switches are turned on; in the fourth step, only the third switch is turned on.

A fourth aspect of the present invention provides the display device, according to a first aspect of the present invention, in which each impedance conversion circuit includes: an amplifier circuit having an input terminal connected to an output circuit node of the voltage shifting circuit; a first switch configured to open and close between the input terminal of the amplifier circuit and an output terminal of the amplifier circuit; a second switch configured to open and close between the output terminal of the amplifier circuit and an output circuit node of the impedance conversion circuit; and a third switch configured to open and close between the output circuit node of the impedance conversion circuit and the output circuit node of the amplitude expansion circuit.

In the fourth aspect of the present invention, in the first step, only the first switch is turned on; also in the second and the third steps, only the first switch is turned on; in the fourth step, only the second and the third switches are turned on.

DESCRIPTION OF THE EMBODIMENT

Figure 1:
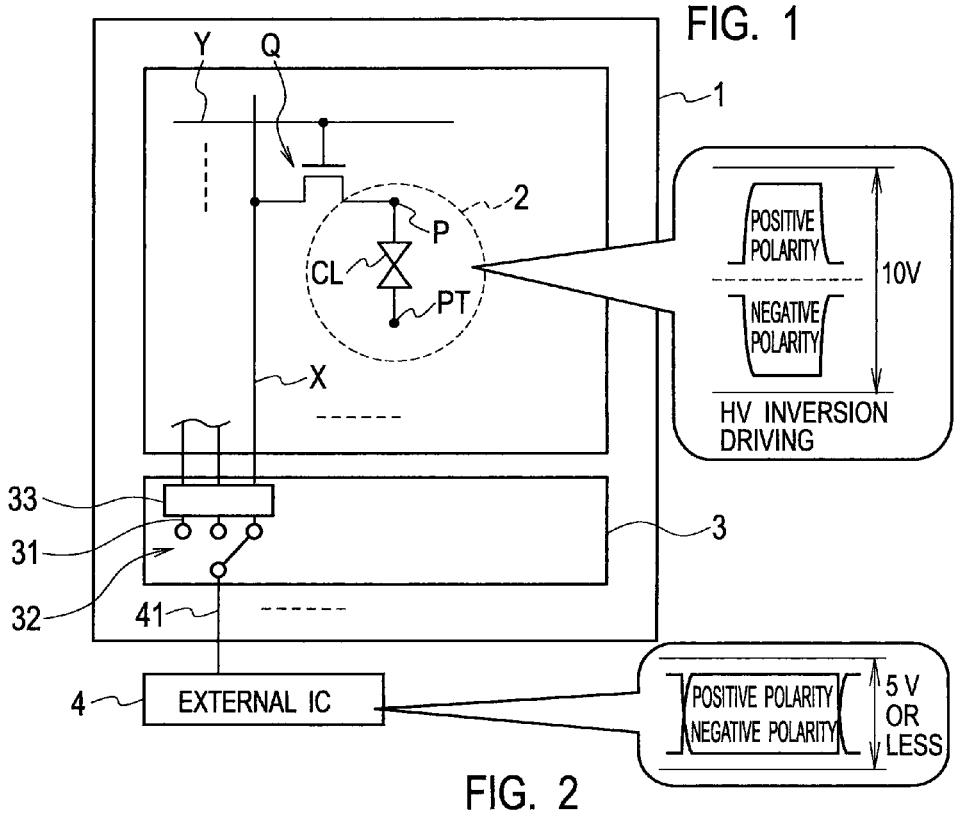
FIG. 1 shows a schematic configuration of a display device according to an embodiment.

As shown in FIG. 1, a display device according to an embodiment is a liquid crystal display device including an array substrate 1, multiple signal lines X and multiple scanning lines Y, pixels 2, a signal line driving circuit 3, an unillustrated scanning line driving circuit and an integrated circuit 4 (referred to as an "external IC" in the drawings and descriptions below). The signal lines X and the scanning lines Y intersect with each other in the array 1. The pixels 2 are formed respectively at intersecting portions of the signal lines X and the scanning lines Y. The signal line driving circuit 3 is formed in the array substrate 1. The scanning line driving circuit is formed in the array substrate 1. The external IC 4 is provided separately from the array substrate 1.

A material of the array substrate 1 is polysilicon, for example. Transistors in the pixels 2, the signal line driving circuit 3 and the scanning line driving circuit are thin film transistors (TFTs) made using thin film of polysilicon.

Note that, although not illustrated in FIG. 1, the liquid crystal display device further includes: an opposite substrate disposed opposite to the array substrate 1 with a predetermined space in between; and a liquid crystal layer interposed between the array substrate 1 and the opposite substrate. An unillustrated opposite electrode is formed in the opposite substrate.

Each pixel 2 includes: a pixel transistor Q connected to the corresponding signal line X and scanning line Y; a pixel electrode P connected to the pixel transistor Q; and a liquid crystal capacitance CL serving as a part of a liquid crystal layer. The liquid crystal capacitance CL is interposed between the pixel electrode P and a part of an opposite electrode (represented by reference symbol PT) opposite to the pixel electrode P.

Multiple circuit lines 41 are provided between the external IC 4 and the signal line driving circuit 3.

The signal line driving circuit 3 includes the same number of video bus lines 31 as that of the signal lines X. Further, the signal line driving circuit 3 includes a distributor 32 and a waveform processor 33 for each circuit line 41. The distributor 32 distributes an analog video signal applied to the circuit line 41 by the external IC 4, to, for example, three video bus lines 31 corresponding to the circuit line 41, by using time-division multiplexing. The waveform processor 33 performs waveform processing on the analog video signal applied to each of the three video bus lines 31, and applies the resultant analog video signal to a corresponding one of the signal lines X, for example.

The waveform processor 33 includes at least one of a positive polarity circuit and a negative polarity circuit (collectively referred to as a waveform processing circuit). In this embodiment, for example, in case so-called HV inversion driving is performed for the purpose of improving image quality, positive and negative polarity analog video signals are applied respectively to the pixels 2. The maximum amplitude value of each of the analog video signals is about 10 V.

Meanwhile, analog video signals supplied from the external IC 4 are similarly of two types; however, the maximum amplitude value of each of the analog video signals supplied from the external IC 4 can be made 5 V or less, by using a device configuration and operation to be described below. As a result, it is possible to achieve low power consumption of the external IC 4 as well as cost reduction and miniaturization of an internal circuit pattern.

Although the maximum amplitude value of each analog video signal is about 10 V, a voltage of the opposite electrode PT is 5 V, for example. Accordingly, a voltage of about 5 V at the maximum is applied to each of the pixels 2.

For example, assume that an operation mode of the liquid crystal layer is selected as a twisted nematic (TN) mode and the liquid crystal display device operates normally white. In this case, for example, when a voltage is applied to the pixel 2, the light transmittance of the liquid crystal capacitance CL becomes zero. For example, when environmental light reflects at the pixel electrode P, the resultant light is not transmitted through the liquid crystal capacitance CL, but is blocked by the liquid crystal capacitance CL. In other words, what is called black display is performed.

In contrast, when the analog video signal is 5 V and a voltage is not applied to the pixel 2, the light transmittance of the liquid crystal capacitance CL is the maximum. Accordingly, the pixel 2 transmits light. In other words, what is called white display is performed.

Note that, a back light is sometimes provided on a back surface side of the array substrate 1. In this case, for example, the pixel 2 blocks or transmits light from the back light. In this way, the black display or white display is performed.

In the white display, a voltage of the analog video signal is adjusted so that a voltage applied to the pixel 2 would be an intermediate voltage between 0 V to 5 V. With this adjustment, an intermediate gradation display is performed. Hereinafter, descriptions are provided for operations of the black display and white display. Here, a description for the intermediate gradation display is omitted, because the intermediate gradation display can also be performed as long as the black display and the white display can be performed.

Figure 2:
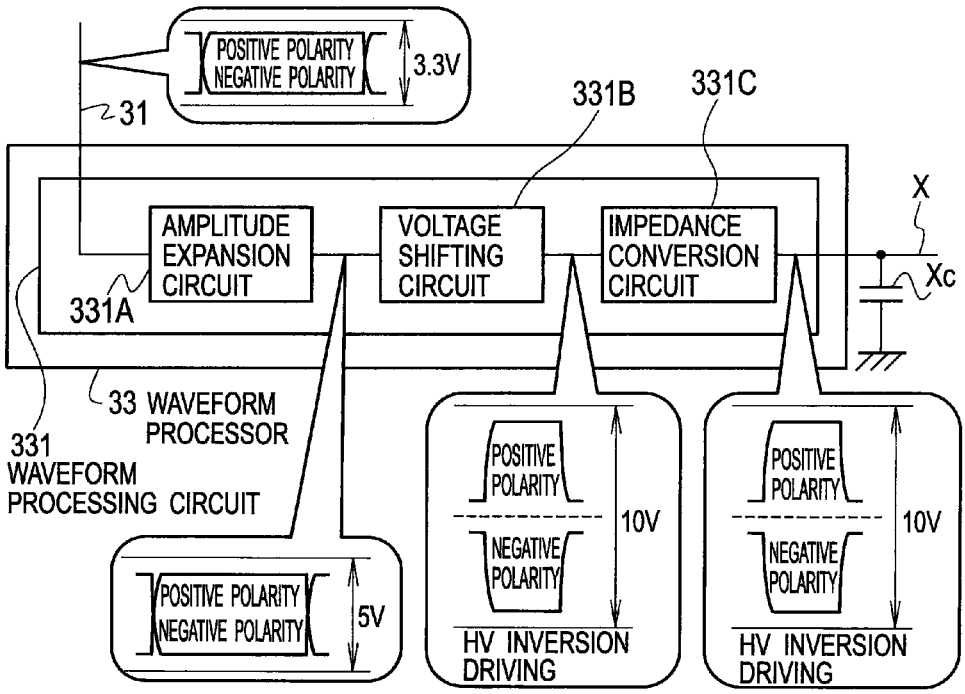
FIG. 2 shows a schematic configuration of a waveform processing circuit.

As shown in FIG. 2, a waveform processing circuit 331 in the waveform processor 33 includes an amplitude expansion circuit 331A, a voltage shifting circuit 331B and an impedance conversion circuit 331C.

The amplitude expansion circuit 331A expands amplitude of the analog video signal applied to each video bus line 31. The voltage shifting circuit 331B shifts a voltage of the analog video signal outputted from the amplitude expansion circuit 331A. The impedance conversion circuit 331C has an output impedance lower than an output impedance of the voltage shifting circuit 331B. The impedance conversion circuit 331C outputs an analog video signal having the same voltage as a voltage of the analog video signal outputted from the voltage shifting circuit 331B, to a corresponding one of the signal lines X. Each signal line X includes a signal line capacitance Xc.

The maximum amplitude value of the analog video signal applied to the video bus line 31 is 3.3 V. The maximum amplitude value of the analog video signal outputted from the amplitude expansion circuit 331A is 5 V. The maximum amplitude value of each of the analog video signals outputted respectively from the voltage shifting circuit 331B and the impedance conversion circuit 331C is 10 V.

Figure 3:
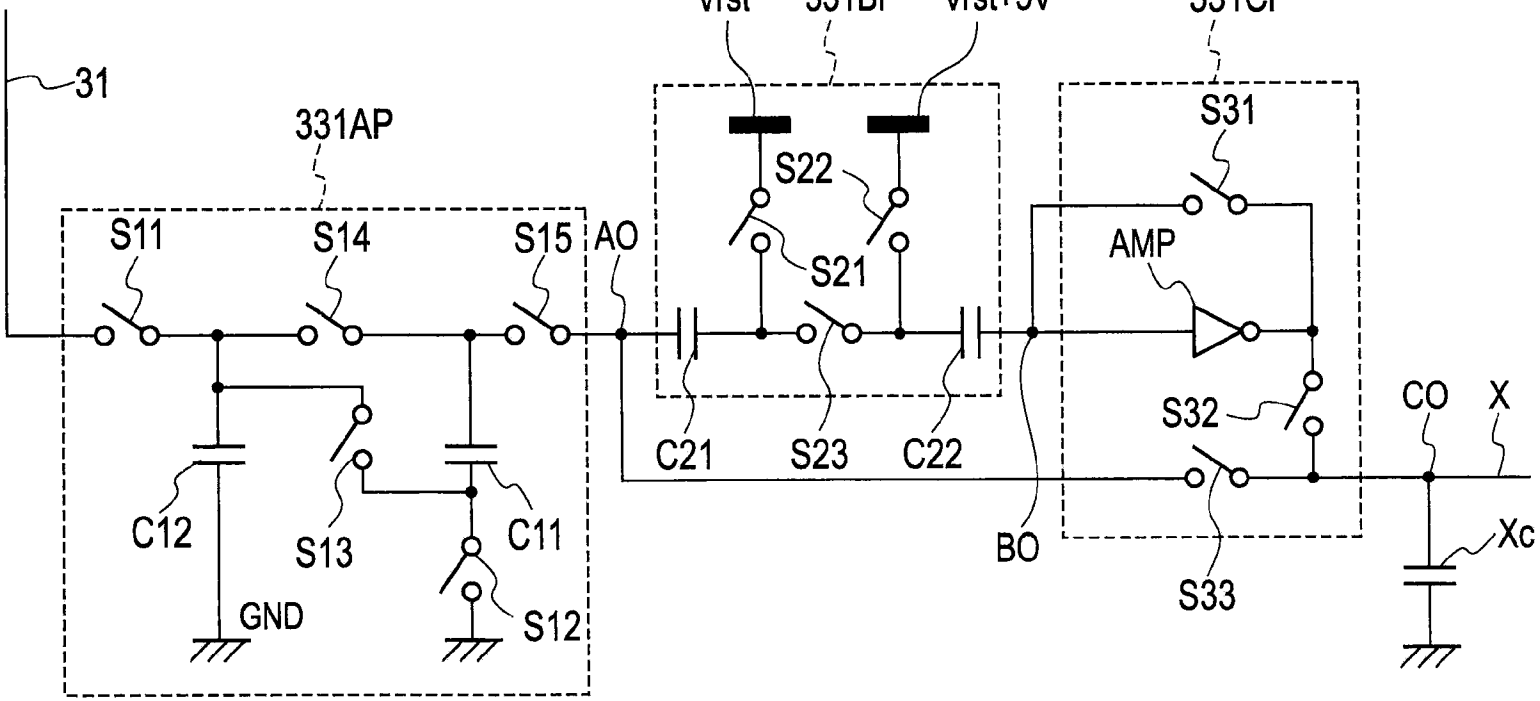
FIG. 3 shows a positive polarity circuit.

As shown in FIG. 3, an amplitude expansion circuit 331AP of a positive polarity circuit 33P includes a first capacitor C11, a second capacitor C12, a first switch S11, a second switch S12, a third switch S13, a fourth switch S14 and a fifth switch S15. All the switches are analog switches using transistors, and the same applies hereinafter.

One electrode of the second capacitor C12 is connected to the ground GND. The first switch S11 opens and closes between the other electrode of the second capacitor C12 and the video bus line 31, i.e. an input circuit node of the analog video signal. The second switch S12 opens and closes between one electrode of the first capacitor C11 and the ground GND. The third switch S13 opens and closes between one electrode of the first capacitor C11 and the other electrode of the second capacitor C12. The fourth switch S14 opens and closes between the other electrode of the first capacitor C11 and the other electrode of the second capacitor C12. The fifth switch S15 opens and closes between the other electrode of the first capacitor C11 and an output circuit node AO.

A voltage shifting circuit 331BP of the positive polarity circuit 33P includes a first capacitor C21, a second capacitor C22, a first switch S21, a second switch S22 and a third switch S23.

One electrode of the first capacitor C21 is connected to the corresponding output circuit node AO of the amplitude expansion circuit 331AP. One electrode of the second capacitor C22 is connected to an output circuit node BO of the voltage shifting circuit 331BP. The first switch S21 opens and closes between the other electrode of the first capacitor C21 and a reference point to which a predetermined reference voltage Vrst is supplied. The second switch S22 opens and closes between the other electrode of the second capacitor C22 and a reference point to which a reference voltage Vrst+5 V, that is, 5 V higher than the reference voltage Vrst, is supplied. The third switch S23 opens and closes between the other electrode of the first capacitor C21 and the other electrode of the second capacitor C22.

An impedance conversion circuit 331CP of the positive polarity circuit 33P includes an amplifier circuit AMP, a first switch S31, a second switch S32 and a third switch S33.

The amplifier circuit AMP includes an input terminal connected to the output circuit node BO of the corresponding voltage shifting circuit 331BP. The first switch S31 opens and closes between an input terminal of the amplifier circuit AMP and an output terminal of the amplifier circuit AMP. The second switch S32 opens and closes between an output terminal of the amplifier circuit AMP and an output circuit node CO of the impedance conversion circuit 331 CP, i.e. the corresponding signal line X. The third switch S33 opens and closes between the output circuit node CO of the impedance conversion circuit 331CP and the output circuit node AO of the corresponding amplitude expansion circuit 331AP.

(Positive Polarity Circuit/from 3.3 V to 10 V/Black Display)

Next, described are four steps in which the positive polarity circuit 33P changes a voltage of 3.3 V of the analog video signal applied to the video bus line 31 into 10 V. If the pixel transistor Q is turned on, a voltage of 10 V is also applied to the pixel electrode P. If a voltage of the opposite electrode PT is 5 V, the pixel 2 blocks light, due to potential difference, and thereby what is called black display is performed. Such an operation is called a black display operation of the positive polarity circuit.

Figure 4:
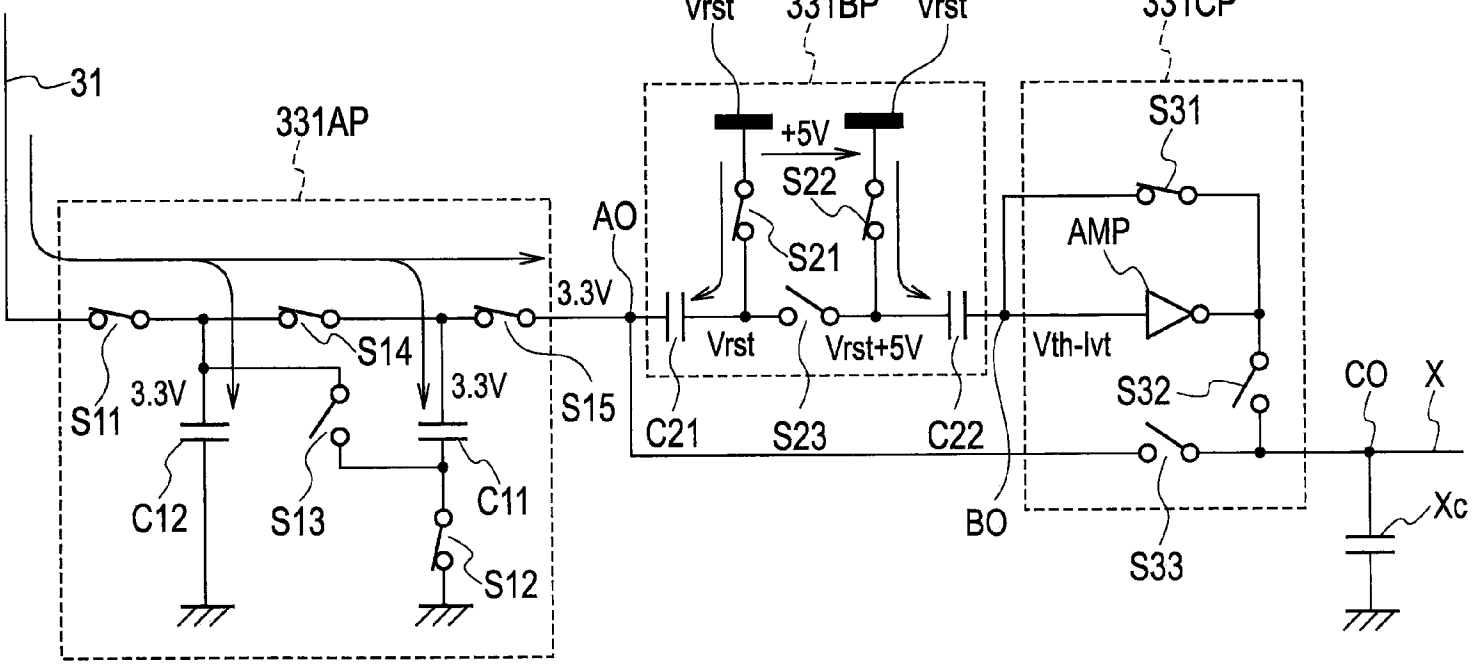
FIG. 4 shows a state in a first step in a black display operation of the positive polarity circuit.

As shown in FIG. 4, in the positive polarity circuit 33P, in the first step, the following switches are turned on: the first switch S11, the second switch S12, the fourth switch S14 and the fifth switch S15 of the amplitude expansion circuit 331 AP; the first switch S21 and the second switch S22 of the voltage shifting circuit 331BP; and the first switch S31 of the impedance conversion circuit 331CP. Meanwhile, all of the other switches are turned off.

Thereby, a voltage of 3.3 V is supplied to the first capacitor C11 and the second capacitor C12 of the amplitude expansion circuit 331AP. The reference voltage Vrst is supplied to the first capacitor C21 of the voltage shifting circuit 331BP. The reference voltage Vrst+5V is supplied to the second capacitor C22 of the voltage shifting circuit 331BP. A voltage of the output circuit node AO of the amplitude expansion circuit 331AP becomes 3.3 V. A voltage of an input terminal of the amplifier circuit AMP becomes a voltage Vth-Ivt that is determined by the internal circuit of the amplifier circuit AMP.

Figure 5:
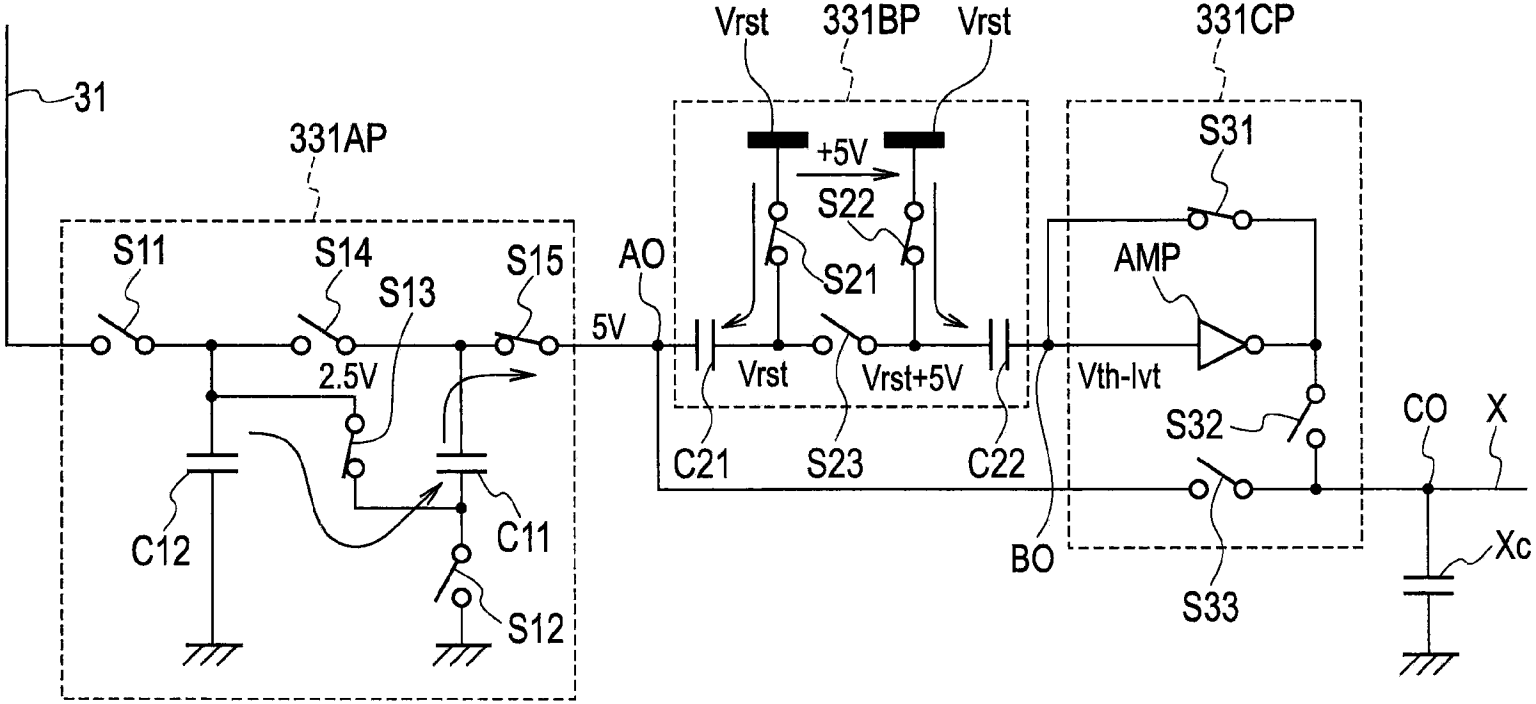
FIG. 5 shows a state in a second step in the black display operation of the positive polarity circuit.

As shown in FIG. 5, in the positive polarity circuit 33P, at the time of transition to the second step, the first switch S11, the second switch S12, and the fourth switch S14 of the amplitude expansion circuit 331AP are turned off. On the other hand, the third switch S13 of the amplitude expansion circuit 331AP is turned on.

Thereby, a voltage of the output circuit node AO of the amplitude expansion circuit 331AP changes from 3.3 V to 5 V. A voltage of the second capacitor C12 changes from 3.3 V to 2.5 V, for example. In order to change each of the voltages in this way, adjustments are made in advance for electrostatic capacitance of the first capacitor C11 and the second capacitor C12 of the amplitude expansion circuit 331AP and the first capacitor C21 of the voltage shifting circuit 331BP, as well as for the reference voltage Vrst.

Figure 6:
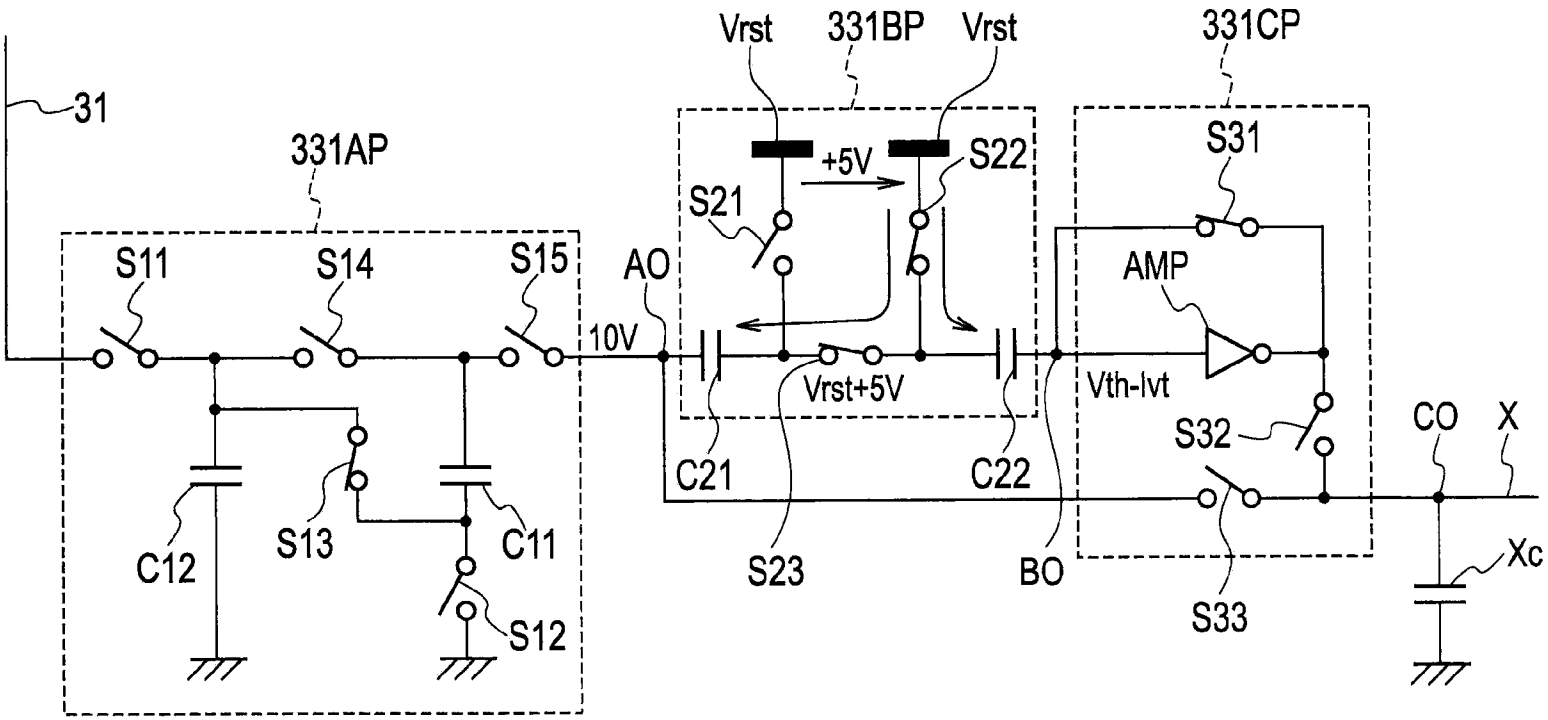
FIG. 6 shows a state in a third step in the black display operation of the positive polarity circuit.

As shown in FIG. 6, in the positive polarity circuit 33P, at the time of transition to the third step, the fifth switch S15 of the amplitude expansion circuit 331AP and the first switch S21 of the voltage shifting circuit 331BP are turned off. On the other hand, the third switch S23 of the voltage shifting circuit 331BP is turned on.

Thereby, a voltage of the output circuit node AO of the amplitude expansion circuit 331AP changes from 5 V to 10 V. Since the output circuit node AO is floating, a voltage of the output circuit node AO shifts by +5 V, i.e. the difference between the reference voltage Vrst and the reference voltage Vrst+5V.

Figure 7:
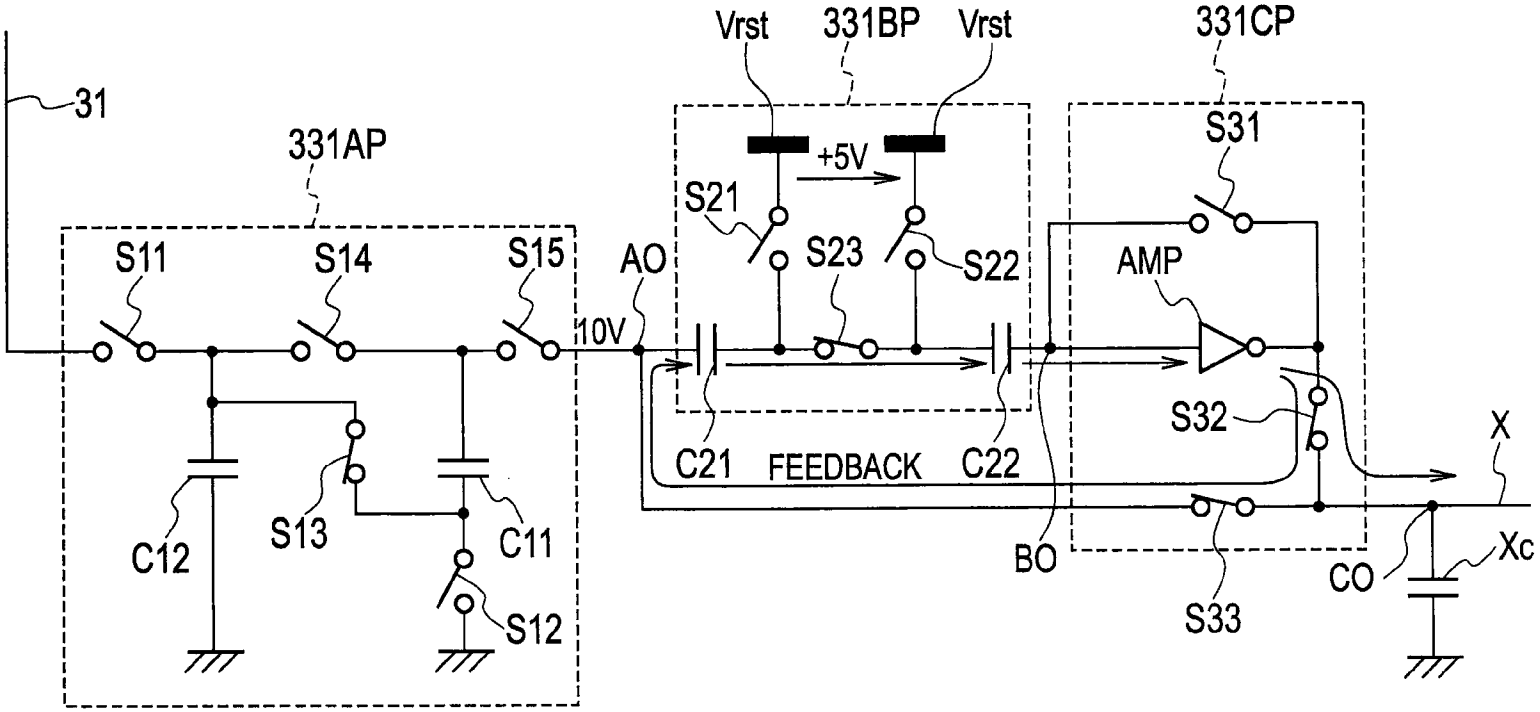
FIG. 7 shows a state in a fourth step in the black display operation of the positive polarity circuit.

As shown in FIG. 7, in the positive polarity circuit 33P, at the time of transition to the fourth step, the second switch S22 of the voltage shifting circuit 331BP and the first switch S31 of the impedance conversion circuit 331CP are turned off. On the other hand, the second switch S32 and the third switch S33 of the impedance conversion circuit 331CP are turned on. Thereby, feedback is provided from an output terminal of the amplifier circuit AMP to the output circuit node AO of the amplitude expansion circuit 331AP. The amplifier circuit AMP supplies a current to the signal line X, while maintaining a voltage of the output circuit node AO at 10 V.

(Positive Polarity Circuit/from 0 V to 5 V/White Display)

Next, described are four steps in which the positive polarity circuit 33P changes a voltage of 0 V of the analog video signal applied to the video bus line 31 into 5 V. If the pixel transistor Q is turned on, a voltage of 5 V is also applied to the pixel electrode P. If a voltage of the opposite electrode PT is 5 V, no potential difference is generated, and the pixel 2 transmits light, and thereby what is called white display is performed. Such an operation is called a white display operation of the positive polarity circuit.

Figure 8:
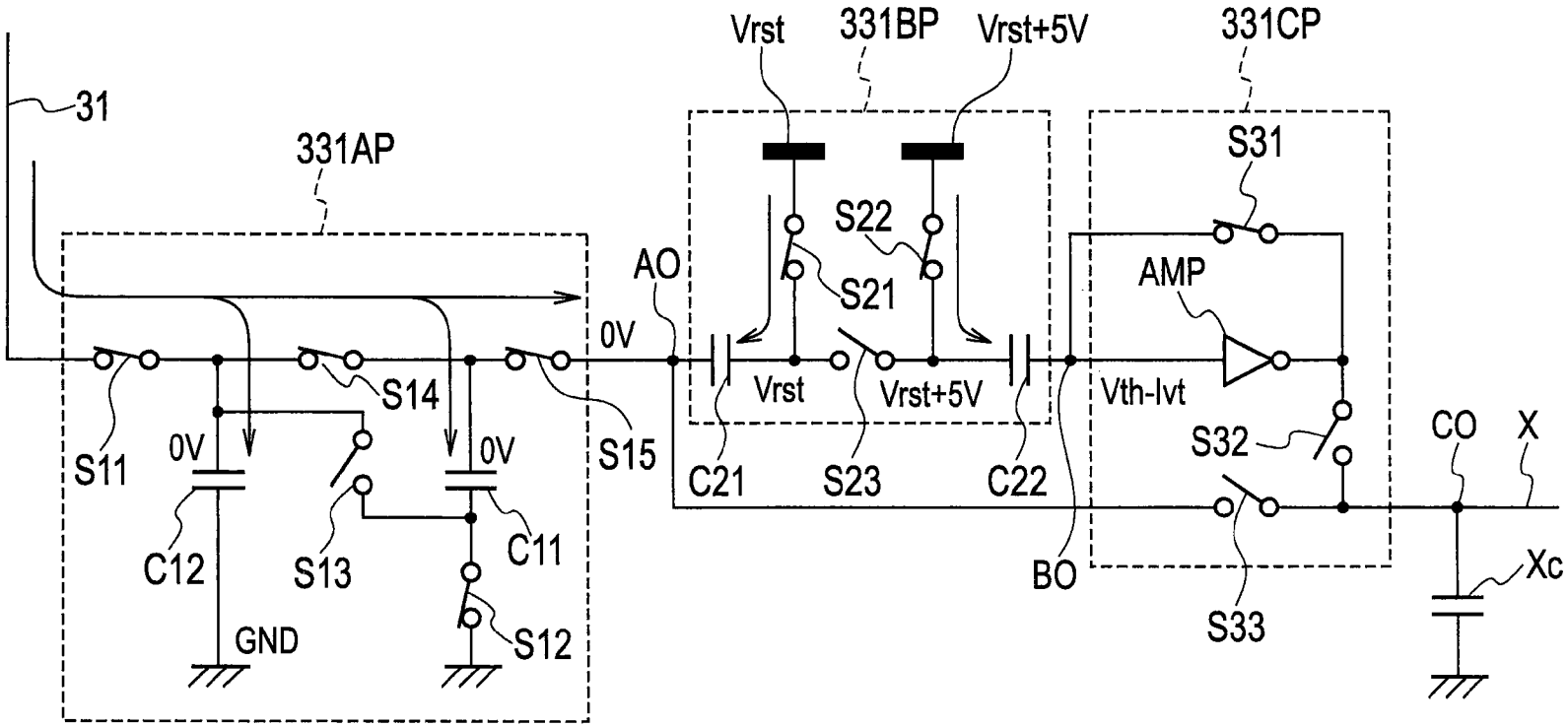
FIG. 8 shows a state in a first step in a white display operation of the positive polarity circuit.

As shown in FIG. 8, in the positive polarity circuit 33P, in the first step, the state of each of the switches is the same as that in the first step of the black display operation of the positive polarity circuit.

Thereby, a voltage of 0 V is supplied to the first capacitor C11 and the second capacitor C12 of the amplitude expansion circuit 331AP, the reference voltage Vrst is supplied to the first capacitor C21 of the voltage shifting circuit 331BP, and the reference voltage Vrst+5V is supplied to the second capacitor C22 of the voltage shifting circuit 331BP. A voltage of the output circuit node AO of the amplitude expansion circuit 331AP also becomes 0 V. A voltage of an input terminal of the amplifier circuit AMP becomes the voltage Vth-Ivt.

Figure 9:
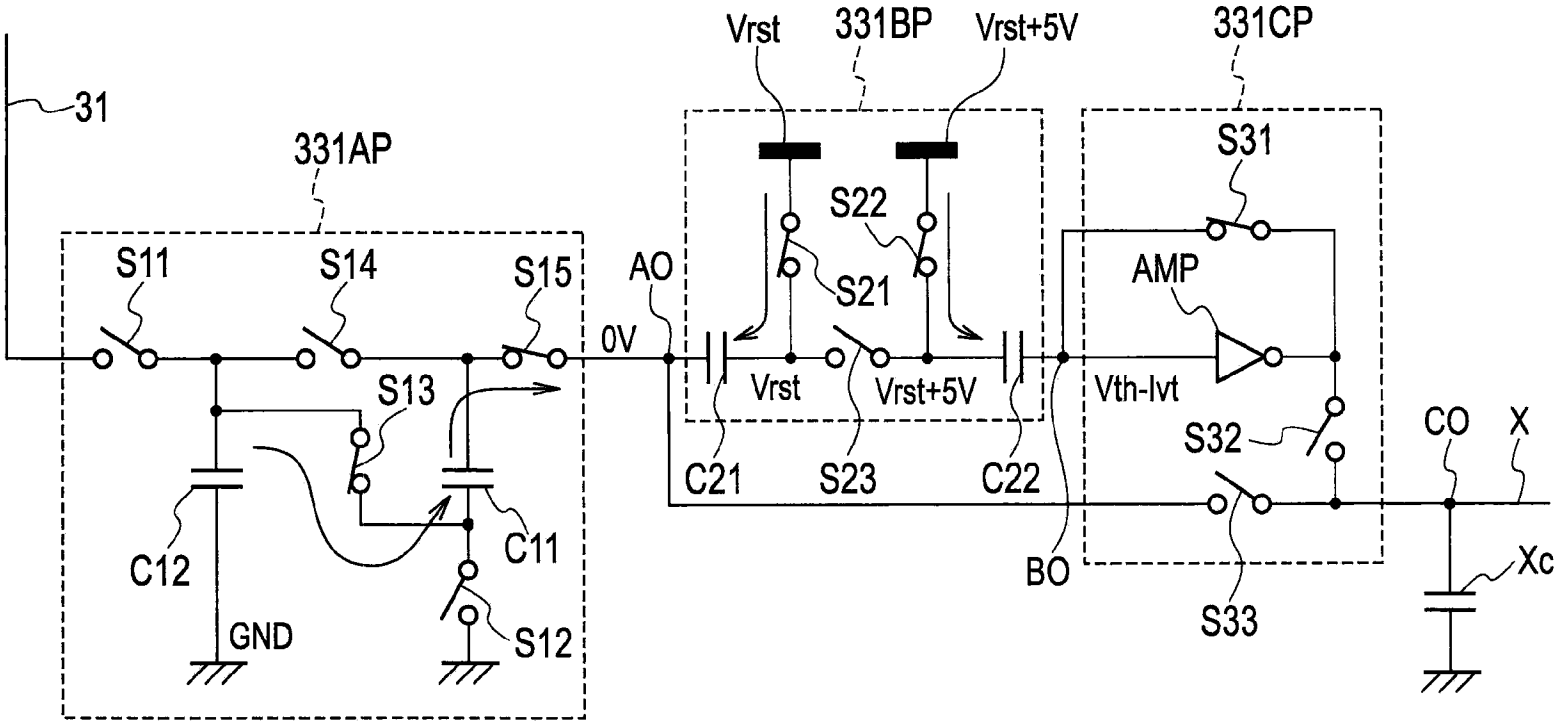
FIG. 9 shows a state in a second step in the white display operation of the positive polarity circuit.

As shown in FIG. 9, in the positive polarity circuit 33P, in the second step, the state of each of the switches is the same as that in the second step of the black display operation of the positive polarity circuit.

Thereby, a voltage of the output circuit node AO of the amplitude expansion circuit 331AP is maintained at 0 V, while a voltage of the second capacitor C12 of the amplitude expansion circuit 331AP is maintained at 0 V, for example. The reason why each of the voltages is maintained at 0 V is that, in the first step, the voltage between the electrodes of the first capacitor C11 of the amplitude expansion circuit 331AP and the voltage the electrodes of the second capacitor C12 of the amplitude expansion circuit 331AP are each 0 V, i.e. the same.

Figure 10:
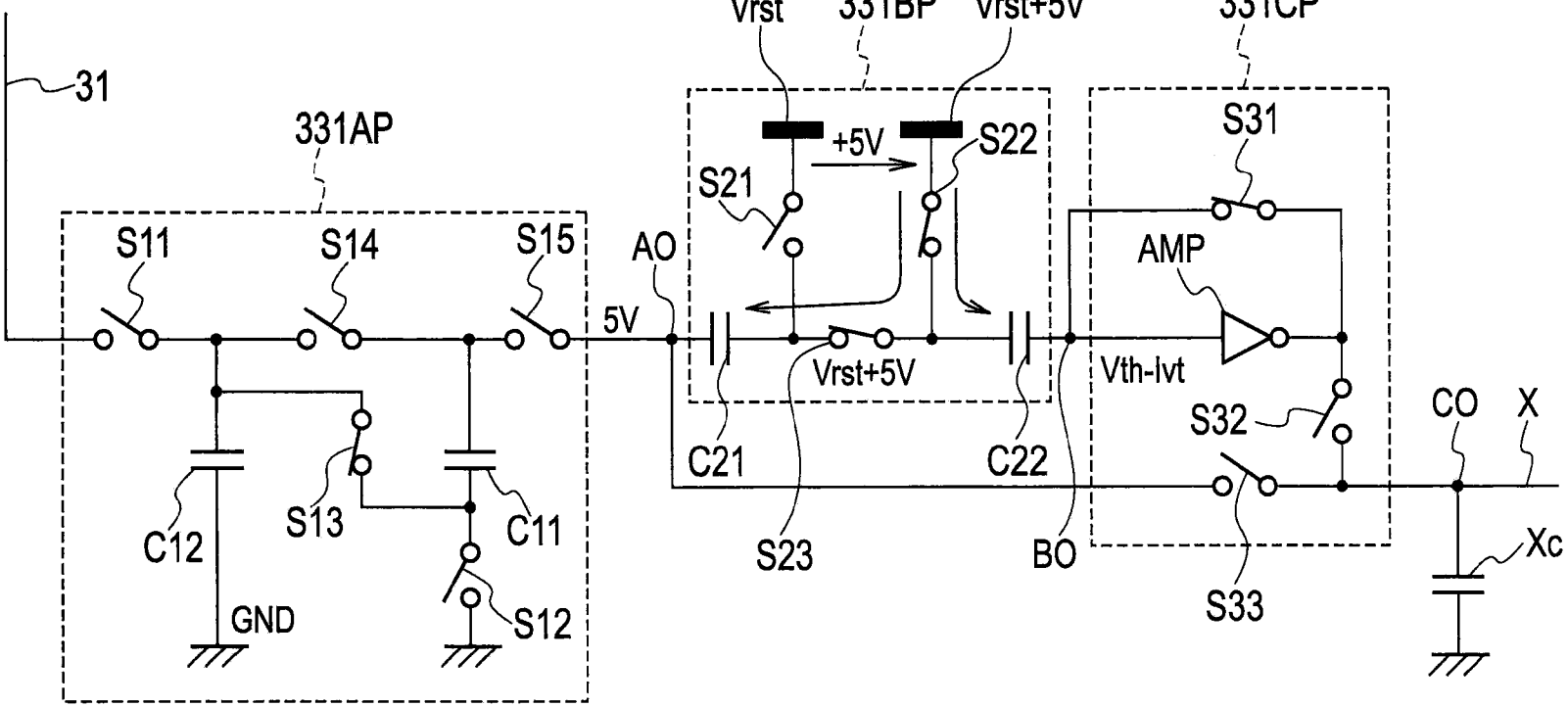
FIG. 10 shows a state in a third step in the white display operation of the positive polarity circuit.

As shown in FIG. 10, in the positive polarity circuit 33P, in the third step, the state of each of the switches is the same as that in the third step of the black display operation of the positive polarity circuit.

Thereby, a voltage of the output circuit node AO of the amplitude expansion circuit 331AP changes from 0 V to 5 V. A voltage of an electrode, of the first capacitor C21, opposite to the output circuit node AO shifts by +5 V, i.e. the difference between the reference voltage Vrst and the reference voltage Vrst+5V. Since the output circuit node AO is floating, a voltage between the electrodes of the first capacitor C21 is maintained, and thereby a voltage of the output circuit node AO changes from 0 V to 5 V.

Figure 11:
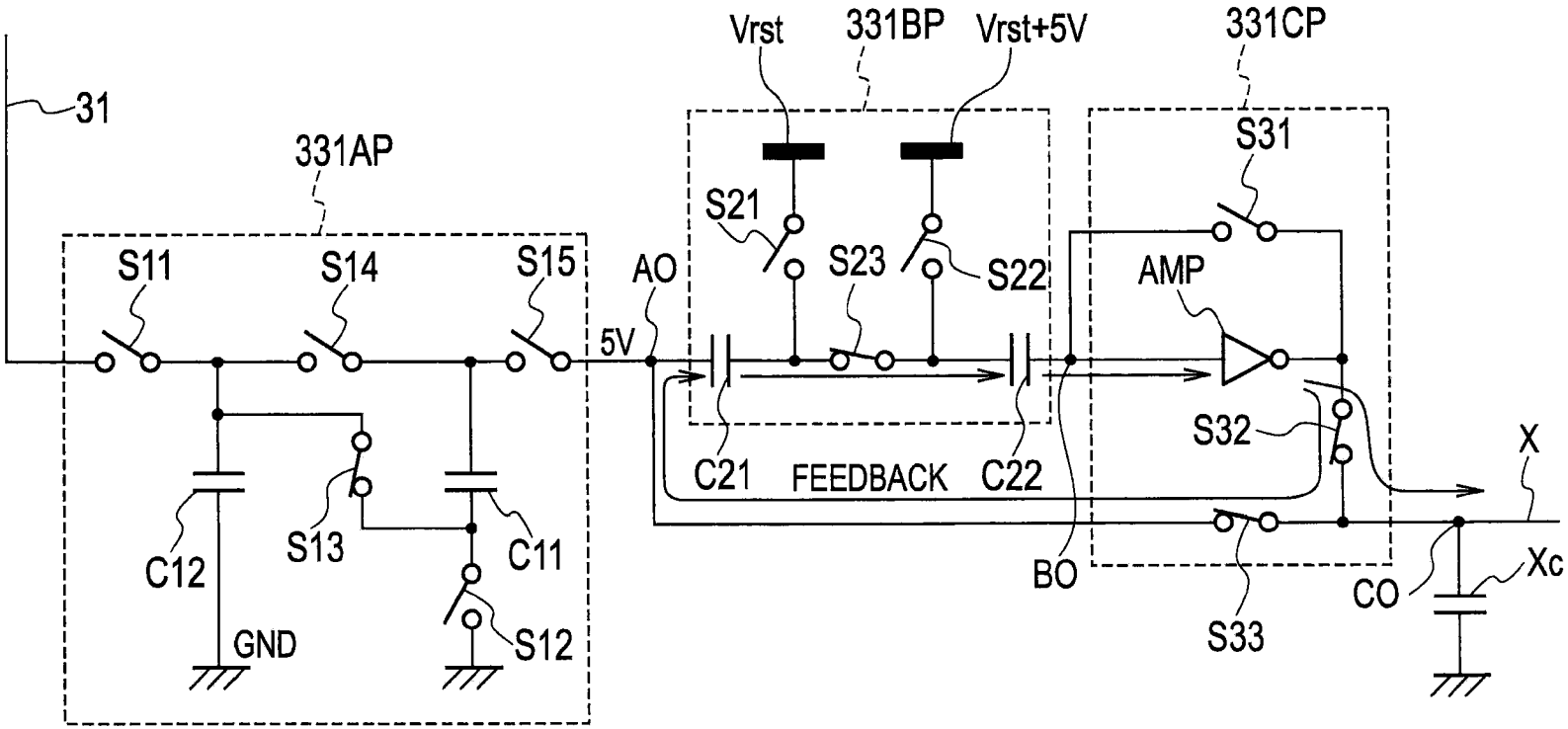
FIG. 11 shows a state in a fourth step in the white display operation of the positive polarity circuit.

As shown in FIG. 11, in the positive polarity circuit 33P, in the fourth step, the state of each of the switches is the same as that in the fourth step of the black display operation of the positive polarity circuit.

Thereby, feedback is provided from an output terminal of the amplifier circuit AMP to the output circuit node AO of the amplitude expansion circuit 331AP. The amplifier circuit AMP supplies a current to the signal line X, while maintaining a voltage of the output circuit node AO at 5 V.

Figure 12:
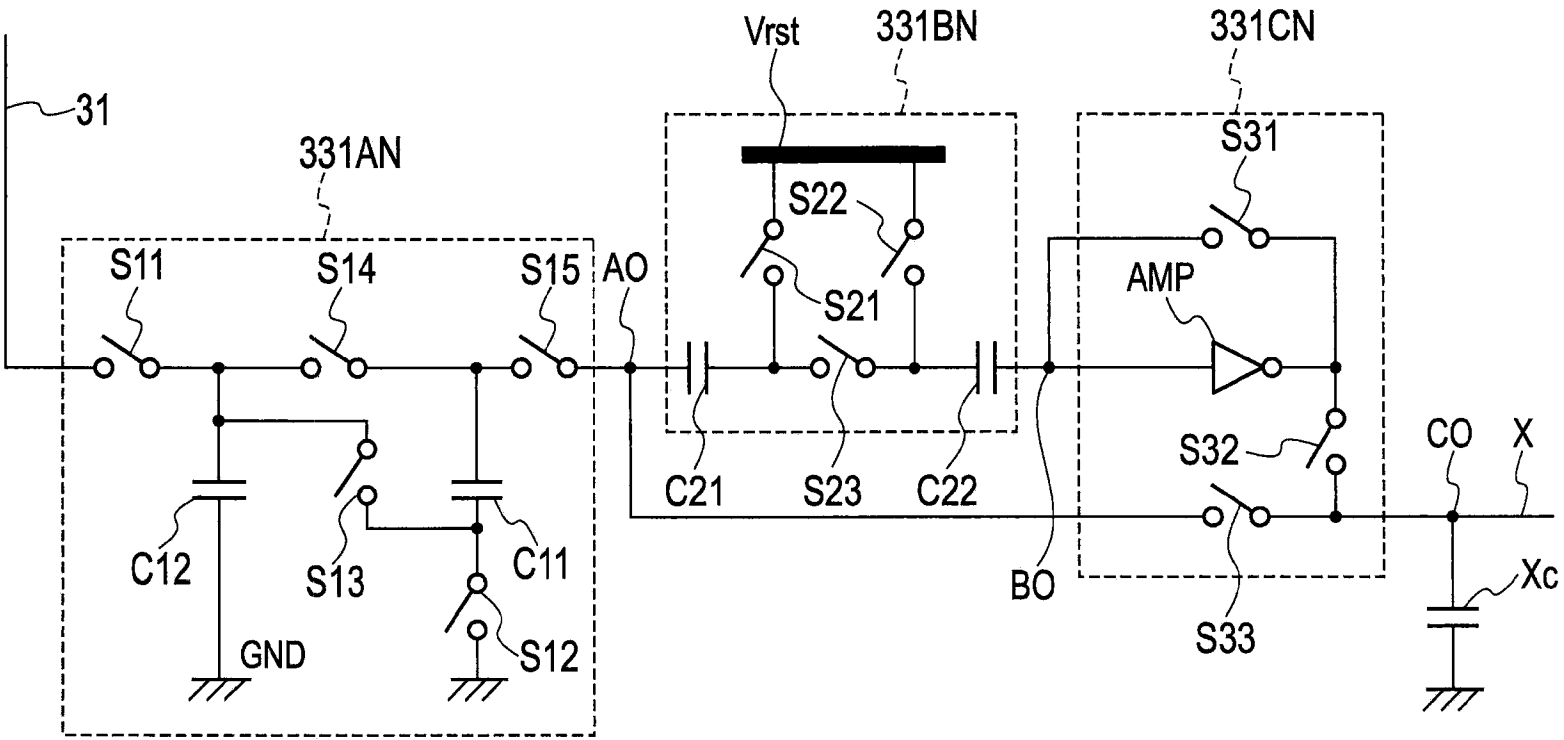
FIG. 12 shows a negative polarity circuit.

As shown in FIG. 12, an amplitude expansion circuit 331AN of a negative polarity circuit 33N is the same as the amplitude expansion circuit 331AP of the positive polarity circuit 33P shown in FIG. 3.

A voltage shifting circuit 331BN of the negative polarity circuit 33N corresponds to the voltage shifting circuit 331BP of the positive polarity circuit 33P with such a change that the second switch S22 opens and closes between the other electrode of the second capacitor C22 and a reference point to which the reference voltage Vrst is supplied.

An impedance conversion circuit 331CN of the negative polarity circuit 33N is the same as the impedance conversion circuit 331CP of the positive polarity circuit 33P.

(Negative Polarity Circuit/from 3.3 V to 5 V/White Display)

Next, described are four steps in which the negative polarity circuit 33N changes a voltage of 3.3 V of the analog video signal applied to the video bus line 31 into 5 V. If the pixel transistor Q is turned on, a voltage of 5 V is also applied to the pixel electrode P. If a voltage of the opposite electrode PT is 5 V, no potential difference is generated, and the pixel 2 transmits light, and thereby what is called white display is performed. Such an operation is called a white display operation of the negative polarity circuit.

Figure 13:
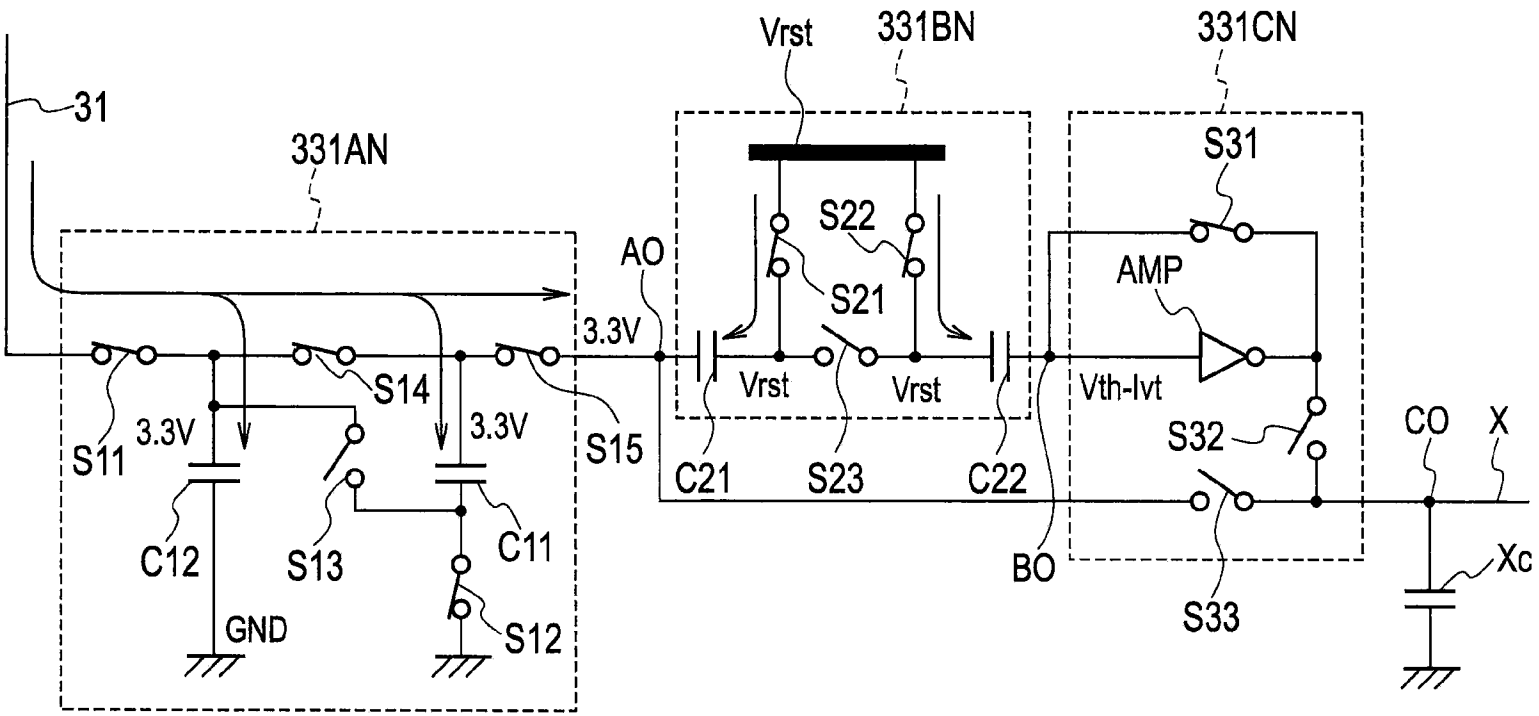
FIG. 13 shows a state in a first step in a white display operation of the negative polarity circuit.

As shown in FIG. 13, in the negative polarity circuit 33N, in the first step, the state of each of the switches is the same as that in the first step of the black display operation of the positive polarity circuit (the state in the first step of the white display operation of the positive polarity circuit).

Thereby, a voltage of 3.3 V is supplied to the first capacitor C11 and the second capacitor C12 of the amplitude expansion circuit 331AN, and the reference voltage Vrst is supplied to the first capacitor C21 and the second capacitor C22 of the voltage shifting circuit 331BN. A voltage of the output circuit node AO of the amplitude expansion circuit 33 LAN also becomes 3.3 V. A voltage of an input terminal of the amplifier circuit AMP becomes the voltage Vth-Ivt.

Figure 14:
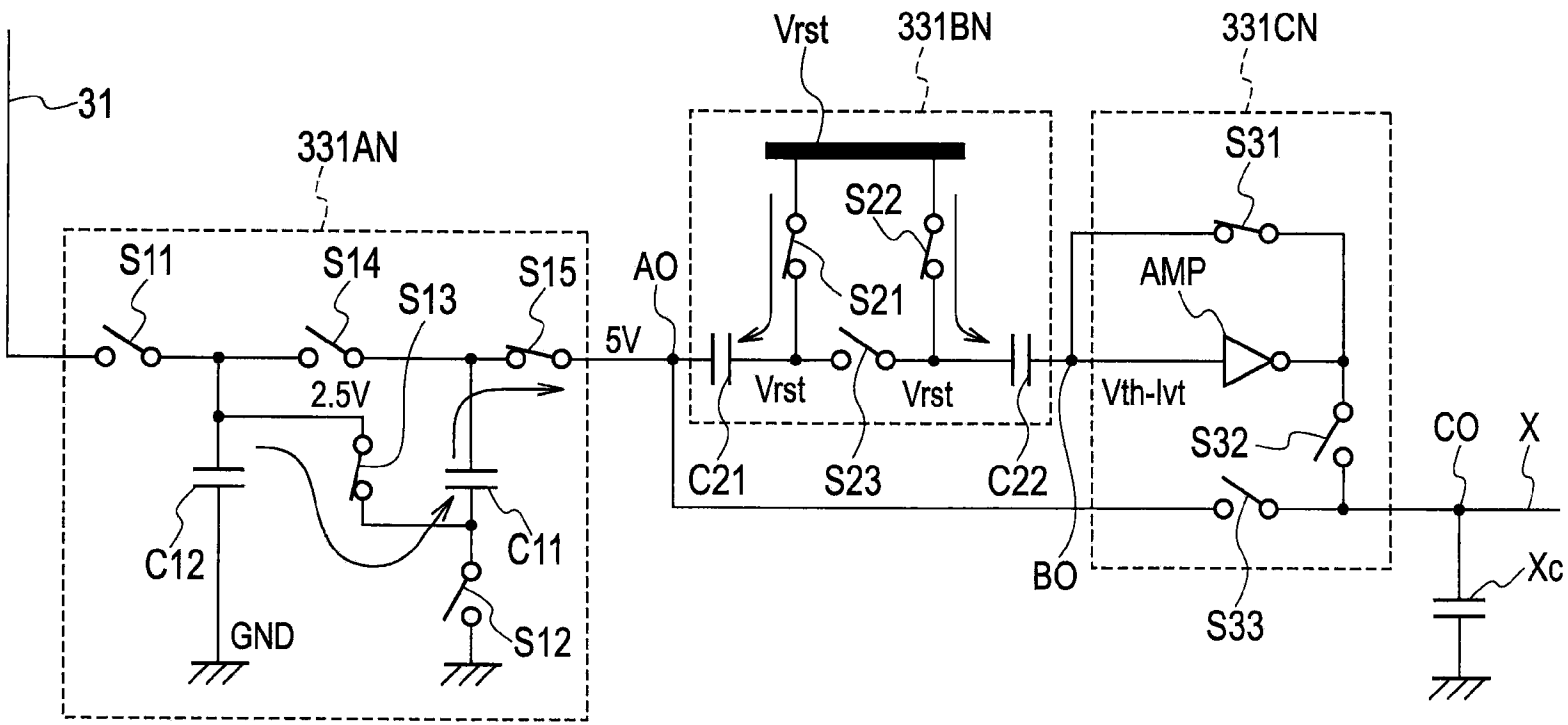
FIG. 14 shows a state in a second step in the white display operation of the negative polarity circuit.

As shown in FIG. 14, in the negative polarity circuit 33N, in the second step, the state of each of the switches is the same as that in the second step of the black display operation of the positive polarity circuit (the state in the second step of the white display operation of the positive polarity circuit).

Thereby, a voltage of the output circuit node AO of the amplitude expansion circuit 331AN changes from 3.3 V to 5 V, while a voltage of the second capacitor C12 of the amplitude expansion circuit 331AN changes from 3.3 V to 2.5 V, for example. The resultant voltages are respectively made 5 V and 2.5 V by making adjustments in advance for electrostatic capacitance of the first capacitor C11 and the second capacitor C12 of the amplitude expansion circuit 331AN and the second capacitor C12 of the amplitude expansion circuit 331AP and the first capacitor C21 of the voltage shifting circuit 331BP, as well as for the reference voltage Vrst.

Figure 15:
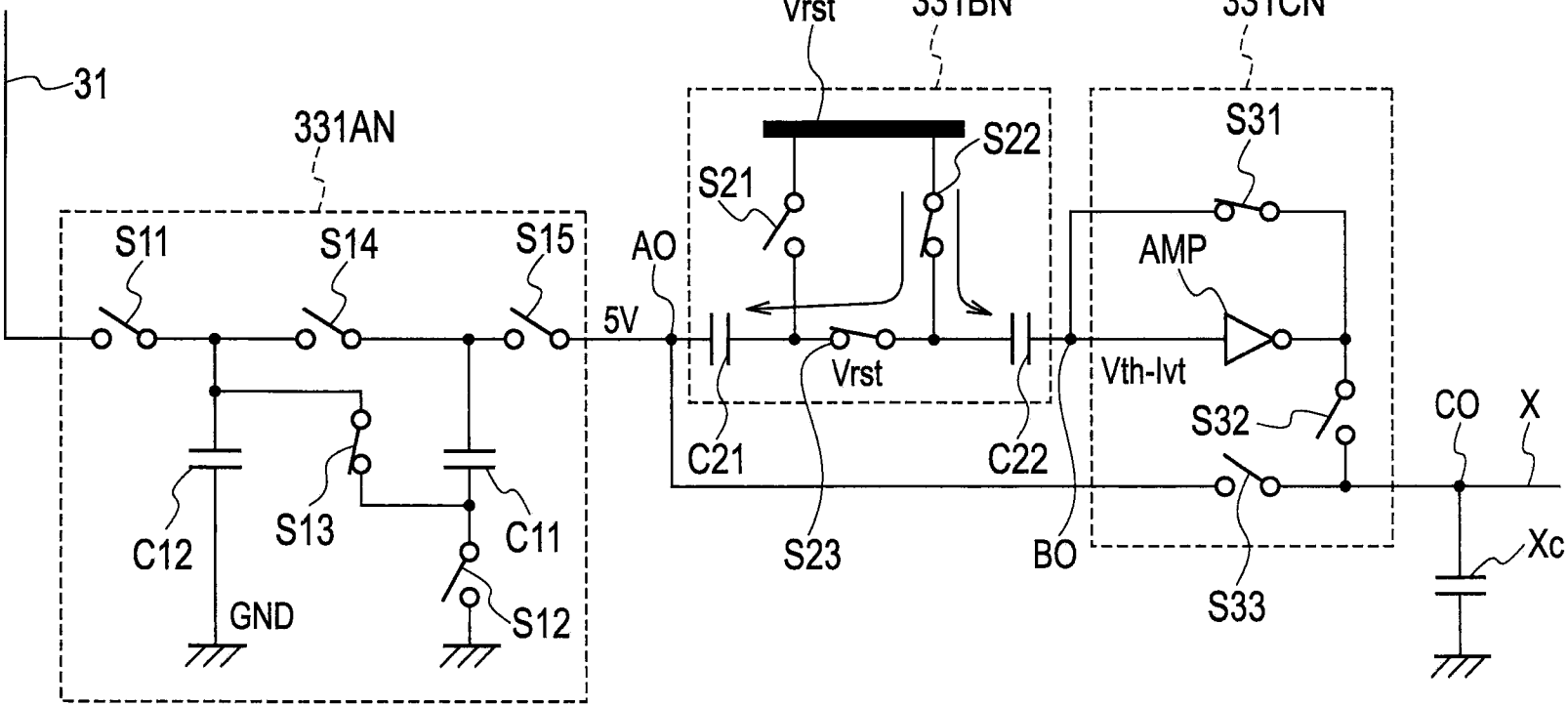
FIG. 15 shows a state in a third step in the white display operation of the negative polarity circuit.

As shown in FIG. 15, in the negative polarity circuit 33N, in the third step, the state of each of the switches is the same as that in the third step of the black display operation of the positive polarity circuit (the state in the third step of the white display operation of the positive polarity circuit).

Thereby, a voltage of the output circuit node AO of the amplitude expansion circuit 331AN is maintained at 5 V. A voltage of an electrode, of the first capacitor C21 of the voltage shifting circuit 331BN, opposite to the output circuit node AO is maintained at the reference voltage Vrst. The output circuit node AO is floating, and a voltage between the electrodes of the first capacitor C21 is maintained. However, unlike the third step of the white display operation of the positive polarity circuit, no voltage shift by the first capacitor C21 is generated, and thereby a voltage of the output circuit node AO is maintained at 5 V.

Figure 16:
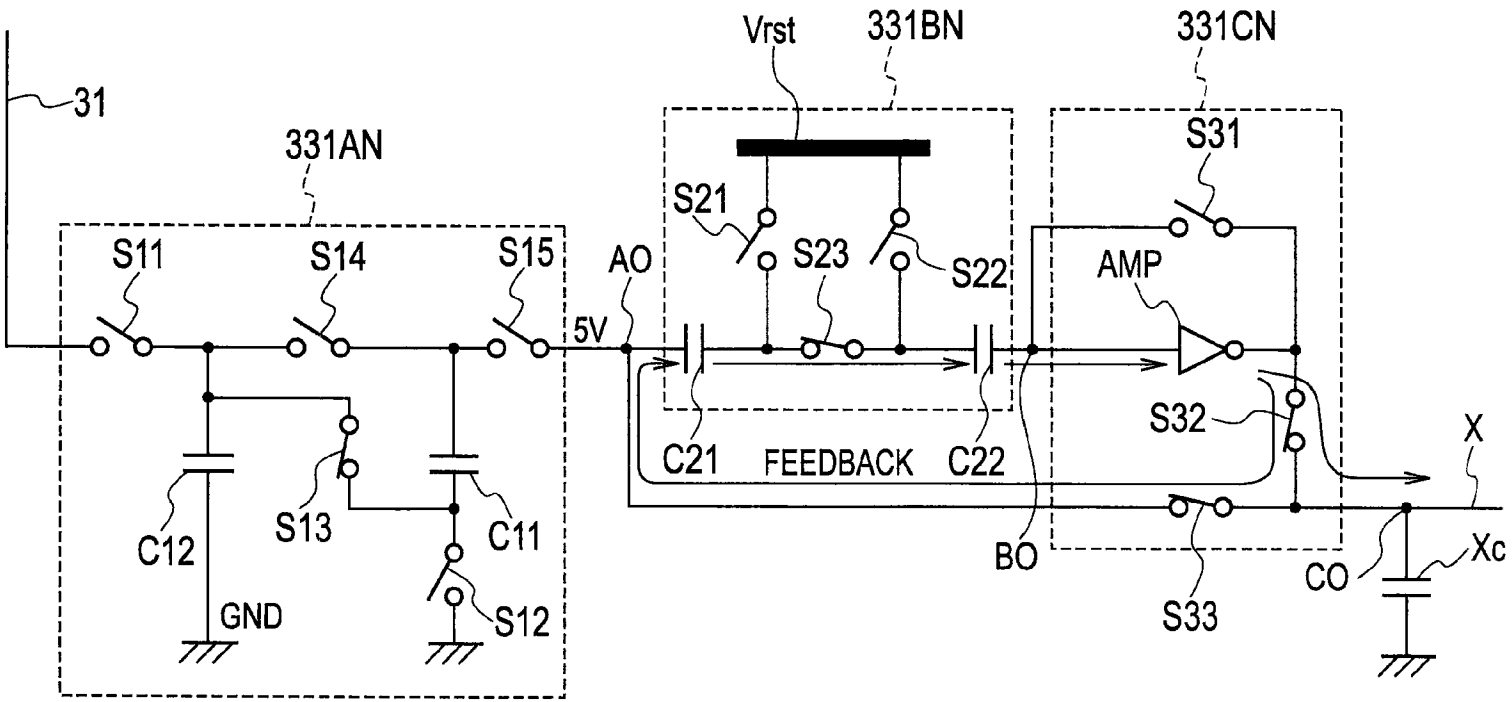
FIG. 16 shows a state in a fourth step in the white display operation of the negative polarity circuit.

As shown in FIG. 16, in the negative polarity circuit 33N, in the fourth step, the state of each of the switches is the same as that in the fourth step of the black display operation of the positive polarity circuit (the state in the fourth step of the white display operation of the positive polarity circuit).

Thereby, feedback is provided from an output terminal of the amplifier circuit AMP to the output circuit node AO of the amplitude expansion circuit 331AN. The amplifier circuit AMP supplies a current to the signal line X, while maintaining a voltage of the output circuit node AO at 5 V.

(Negative Polarity Circuit/from 0 V to 0 V/Black Display)

Next, described are four steps in which the negative polarity circuit 33N maintains a voltage of 0 V of the analog video signal applied to the video bus line 31. If the pixel transistor Q is turned on, a voltage of 0 V is also applied to the pixel electrode P. If a voltage of the opposite electrode PT is 5 V, the pixel 2 blocks light, due to potential difference, and thereby what is called black display is performed. Such an operation is called a black display operation of the negative polarity circuit.

Figure 17:
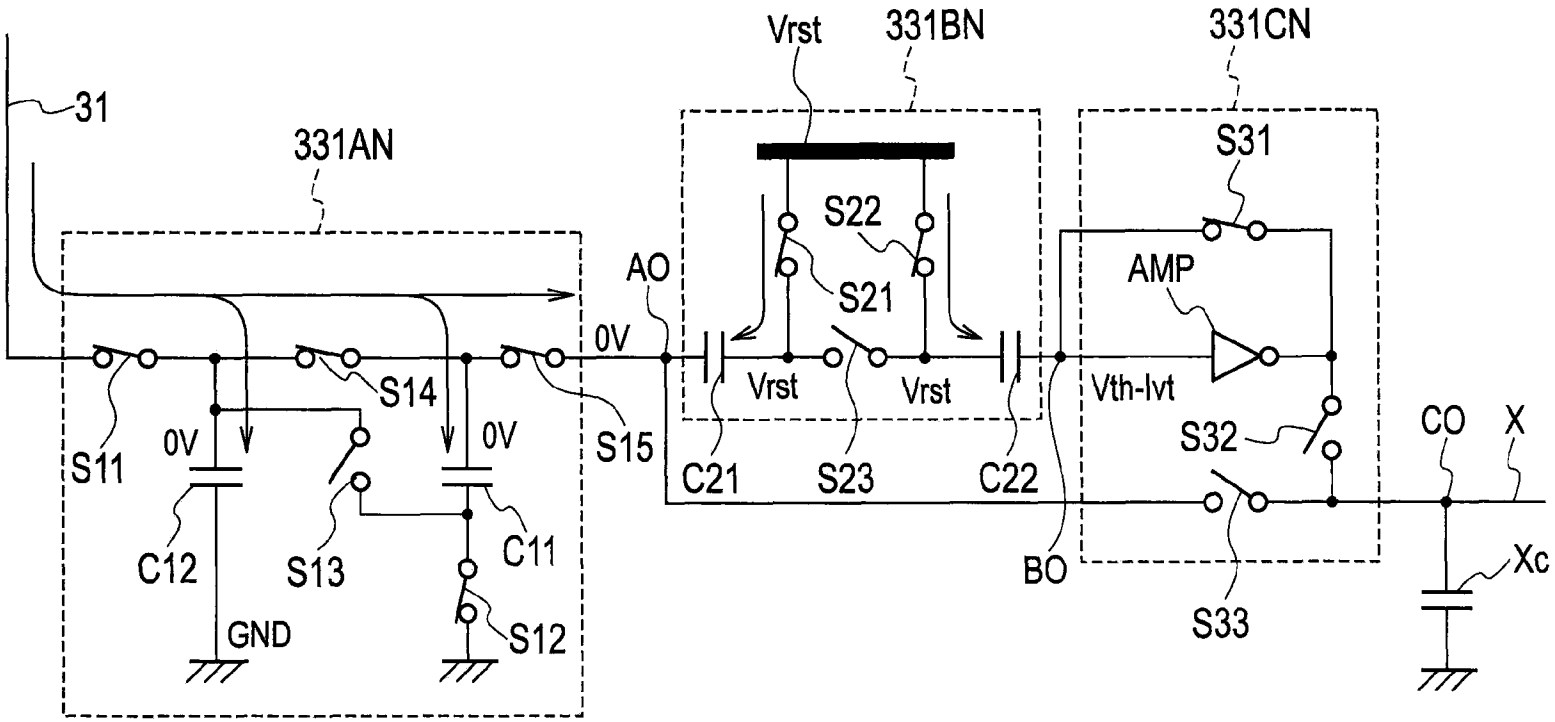
FIG. 17 shows a state in a first step in a black display operation of the negative polarity circuit.

As shown in FIG. 17, in the negative polarity circuit 33N, in the first step, the state of each of the switches is the same as that in the first step of the black display operation of the positive polarity circuit (the state in the first step of the white display operation of the positive polarity circuit/the state in the first step of the white display operation of the negative polarity circuit).

Thereby, a voltage of 0 V is supplied to the first capacitor C11 and the second capacitor C12 of the amplitude expansion circuit 331AN, and the reference voltage Vrst is supplied to the first capacitor C21 and the second capacitor C22 of the voltage shifting circuit 331BN. A voltage of the output circuit node AO of the amplitude expansion circuit 3314N also becomes 0 V. A voltage of an input terminal of the amplifier circuit AMP becomes the voltage Vth-Ivt.

Figure 18:
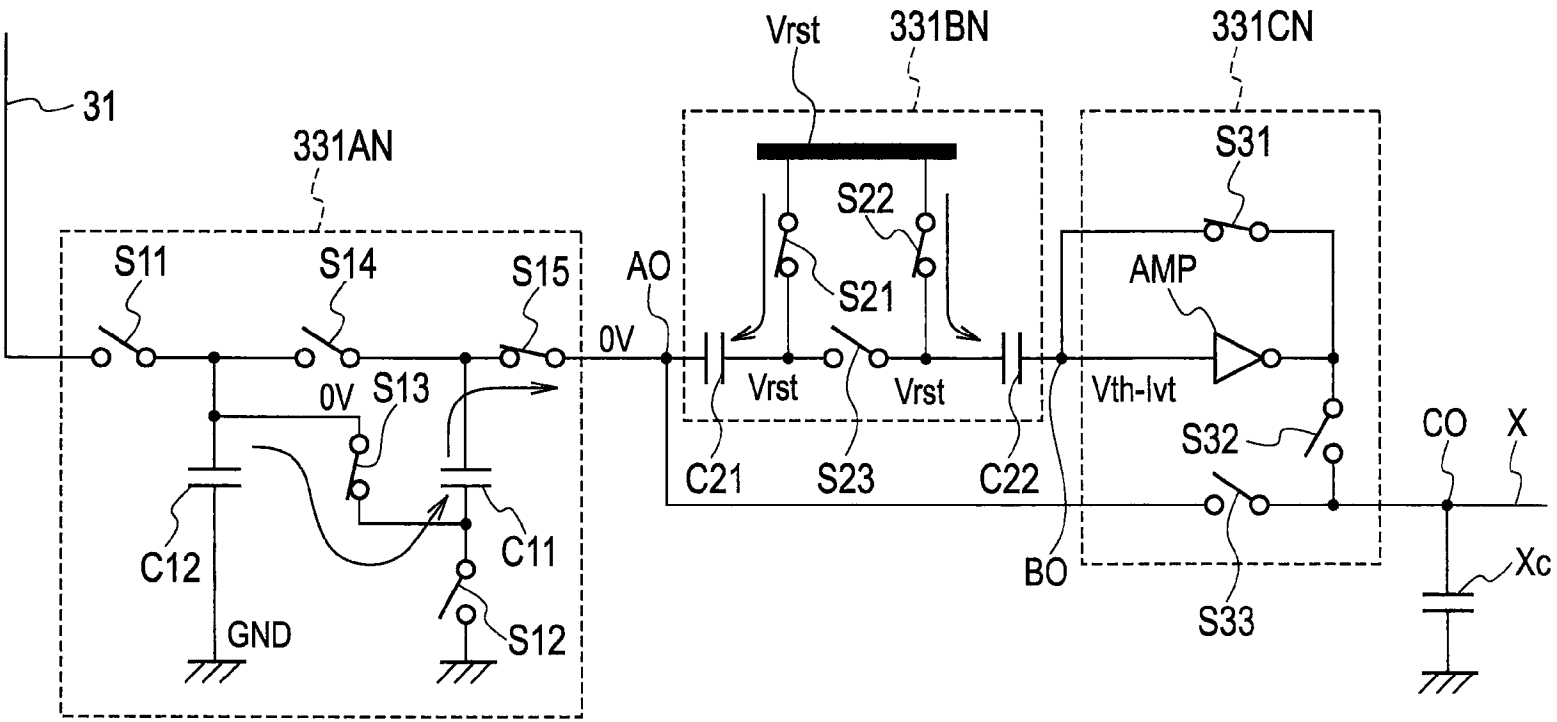
FIG. 18 shows a state in a second step in the black display operation of the negative polarity circuit.

As shown in FIG. 18, in the negative polarity circuit 33N, in the second step, the state of each of the switches is the same as that in the second step of the black display operation of the positive polarity circuit (the state in the second step of the white display operation of the positive polarity circuit/the state in the second step of the white display operation of the negative polarity circuit).

Thereby, voltages of the output circuit node AO of the amplitude expansion circuit 331AN is maintained at 0 V, and the second capacitor C12 of the amplitude expansion circuit 331AN is maintained at 0 V, for example. The reason why each of the voltages is maintained at 0 V is that, in the first step, the voltage between the electrodes of the first capacitor C11 of the amplitude expansion circuit 331AN and the voltage between the electrodes of the second capacitor C12 of the amplitude expansion circuit 331AN are each 0 V, i.e. the same.

Figure 19:
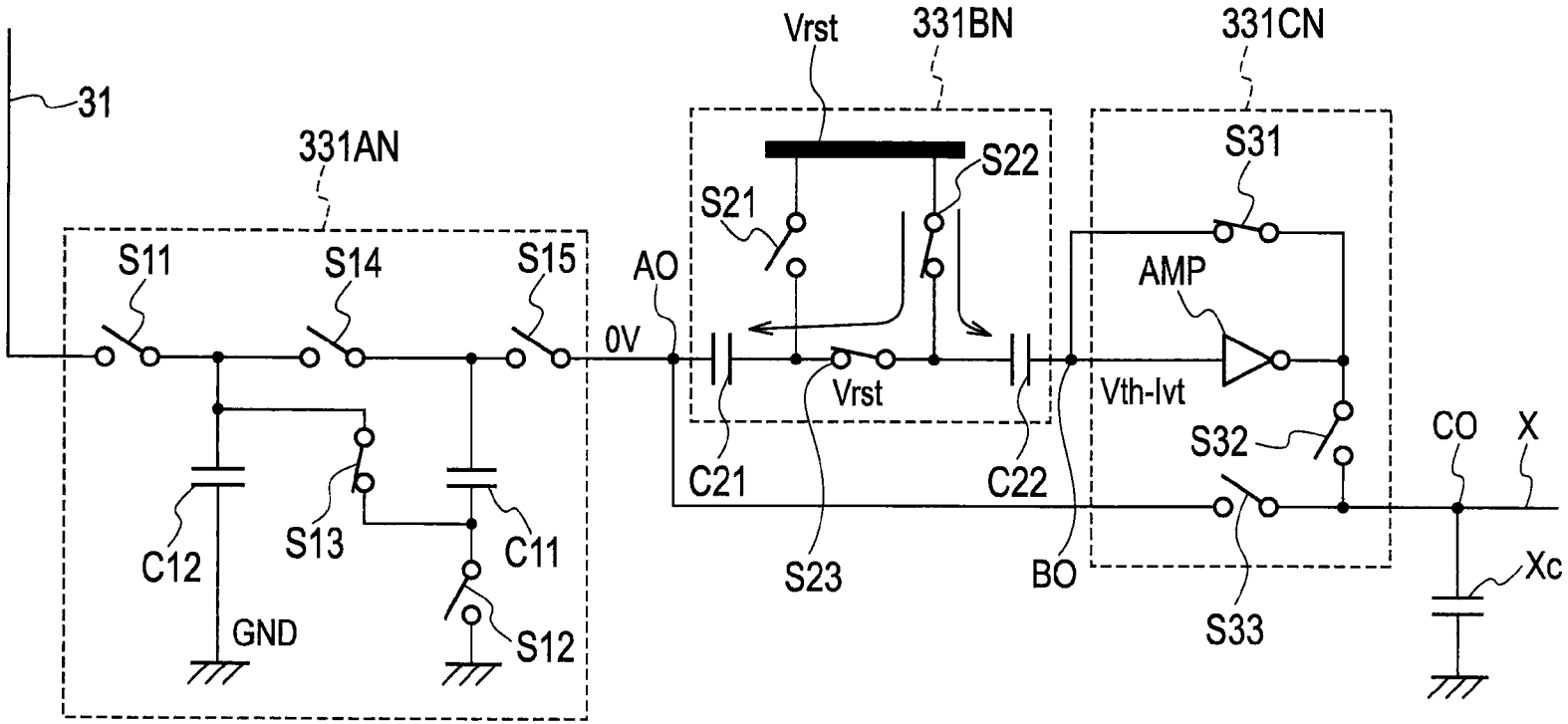
FIG. 19 shows a state in a third step in the black display operation of the negative polarity circuit.

As shown in FIG. 19, in the negative polarity circuit 33N, in the third step, the state of each of the switches is the same as that in the third step of the black display operation of the positive polarity circuit (the state in the third step of the white display operation of the positive polarity circuit/the state in the third step of the white display operation of the negative polarity circuit).

Thereby, a voltage of the output circuit node AO of the amplitude expansion circuit 331AN is maintained at 0 V. A voltage of an electrode, of the first capacitor C21 of the voltage shifting circuit 331BN, opposite from the output circuit node AO is maintained at the reference voltage Vrst. The output circuit node AO is floating, and a voltage between the electrodes of the first capacitor C21 is maintained. However, unlike the third step of the white display operation of the positive polarity circuit, no voltage shift by the first capacitor C21 is generated, and thereby a voltage of the output circuit node AO is maintained at 0 V.

Figure 20:
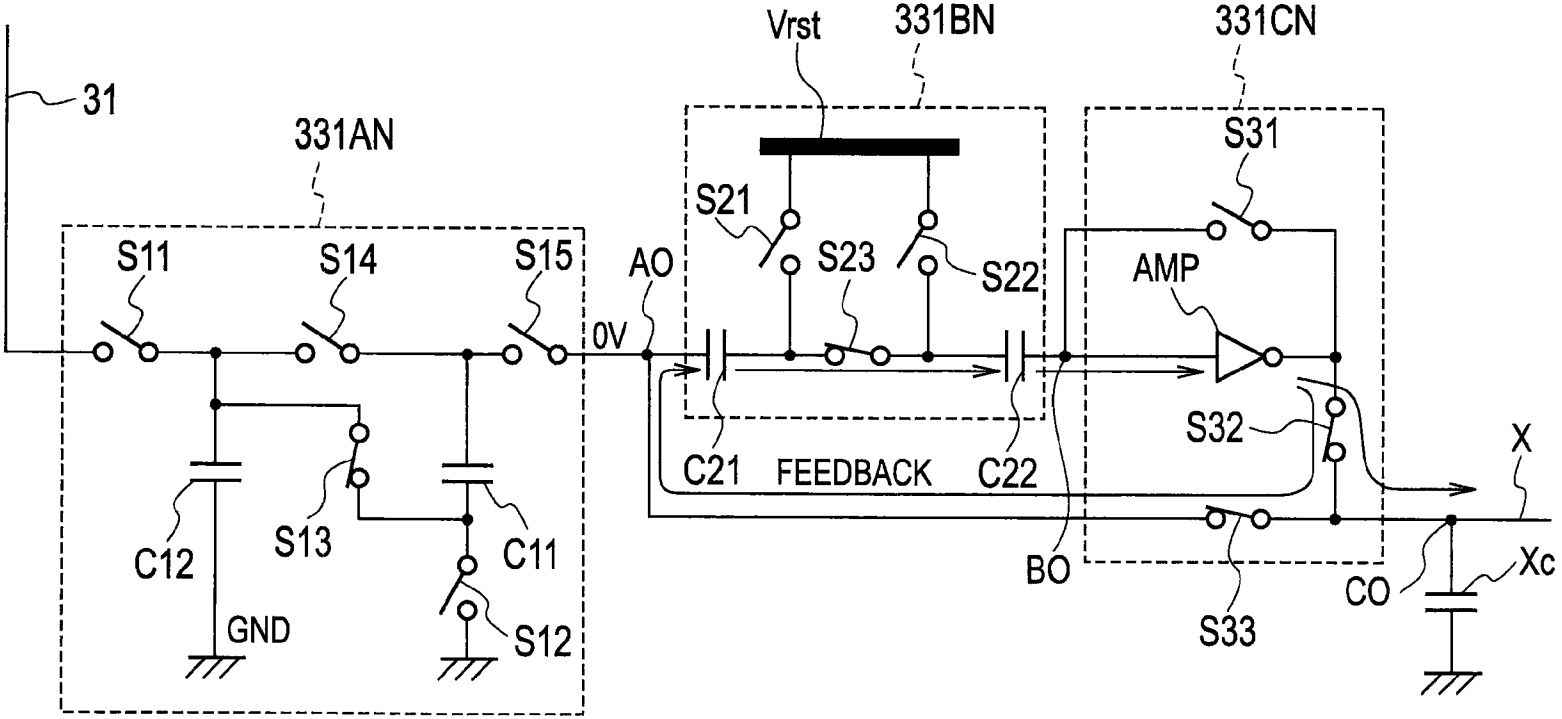
FIG. 20 shows a state in a fourth step in the black display operation of the negative polarity circuit.

As shown in FIG. 20, in the negative polarity circuit 33N, in the fourth step, the state of each of the switches is the same as that in the fourth step of the black display operation of the positive polarity circuit (the state in the fourth step of the white display operation of the positive polarity circuit/the state in the fourth step of the white display operation of the negative polarity circuit).

Thereby, feedback is provided from an output terminal of the amplifier circuit AMP to the output circuit node AO of the amplitude expansion circuit 331AN. The amplifier circuit AMP supplies a current to the signal line X, while maintaining a voltage of the output circuit node AO at 0 V.

As described above, in the liquid crystal display device according to this embodiment, by including the amplitude expansion circuit 331A, the voltage shifting circuit 331B, and the impedance conversion circuit 331C on the array substrate 1, the amplitude of the analog video signal is increased. Thus, it is possible to reduce the voltage of the external IC 4 that is a source for supplying the analog video signal. As a result, it is possible to achieve low power consumption of the external IC 4 as well as cost reduction and miniaturization of the internal circuit pattern.

Note that the present invention is not limited to this embodiment, and may be implemented in the following manner. For example, a material of the array substrate 1 may be amorphous silicon, instead of polysilicon.

Each pixel 2 may not be configured of a liquid crystal, but may be configured by including an organic light-emitting diode (OLEL) that is an element capable of emitting light by itself. In such a case, to perform a display, each pixel 2 thus configured emits light, and an amount of light emission of the pixel 2 is controlled, on the basis of the corresponding analog video signal.

What is claimed is:

1. A display device comprising:

an array substrate;

signal lines and scanning lines formed on the array substrate, the signal lines and the scanning lines intersecting with each other;

a pixel formed at each intersection of the signal line and the scanning line on the array substrate;

an amplitude expansion circuit formed for each signal line on the array substrate and configured to expand amplitude of an inputted analog video signal;

a voltage shifting circuit formed for each amplitude expansion circuit on the array substrate and configured to shift a voltage of an analog video signal outputted from the amplitude expansion circuit; and an impedance conversion circuit formed for each voltage shifting circuit on the array substrate, the impedance conversion circuit having an output impedance lower than that of the voltage shifting circuit and configured to output, to the corresponding signal line, an analog video signal having the same voltage as that of the analog video signal outputted from the voltage shifting circuit;

wherein each amplitude expansion circuit includes:

a first capacitor;

a second capacitor having one electrode grounded;

a first switch configured to open and close between the other electrode of the second capacitor and an input circuit node of the analog video signal;

a second switch configured to open and close between one electrode of the first capacitor and the ground;

a third switch configured to open and close between the one electrode of the first capacitor and the other electrode of the second capacitor;

a fourth switch configured to open and close between the other electrode of the first capacitor and the other electrode of the second capacitor; and a fifth switch configured to open and close between the other electrode of the first capacitor and an output circuit node of the amplitude expansion circuit.

2. A display device comprising:

an array substrate;

signal lines and scanning lines formed on the array substrate, the signal lines and the scanning lines intersecting with each other;

a pixel formed at each intersection of the signal line and the scanning line on the array substrate;

an amplitude expansion circuit formed for each signal line on the array substrate and configured to expand amplitude of an inputted analog video signal;

a voltage shifting circuit formed for each amplitude expansion circuit on the array substrate and configured to shift a voltage of an analog video signal outputted from the amplitude expansion circuit; and an impedance conversion circuit formed for each voltage shifting circuit on the array substrate, the impedance conversion circuit having an output impedance lower than that of the voltage shifting circuit and configured to output, to the corresponding signal line, an analog video signal having the same voltage as that of the analog video signal outputted from the voltage shifting circuit;

wherein each voltage shifting circuit includes:

a first capacitor having one electrode connected to an output circuit node of the amplitude expansion circuit;

a second capacitor having one electrode connected to an output circuit node of the voltage shifting circuit;

a first switch configured to open and close between the other electrode of the first capacitor and a reference point to which a predetermined reference voltage is supplied;

a second switch configured to open and close between the other electrode of the second capacitor and any one of the reference point and a reference point to which a different reference voltage is supplied; and a third switch configured to open and close between the other electrode of the first capacitor and the other electrode of the second capacitor.

3. A display device comprising:

an array substrate;

signal lines and scanning lines formed on the array substrate, the signal lines and the scanning lines intersecting with each other;

a pixel formed at each intersection of the signal line and the scanning line on the array substrate;

an amplitude expansion circuit formed for each signal line on the array substrate and configured to expand amplitude of an inputted analog video signal;

a voltage shifting circuit formed for each amplitude expansion circuit on the array substrate and configured to shift a voltage of an analog video signal outputted from the amplitude expansion circuit; and an impedance conversion circuit formed for each voltage shifting circuit on the array substrate, the impedance conversion circuit having an output impedance lower than that of the voltage shifting circuit and configured to output, to the corresponding signal line, an analog video signal having the same voltage as that of the analog video signal outputted from the voltage shifting circuit;

wherein each impedance conversion circuit includes:

an amplifier circuit having an input terminal connected to an output circuit node of the voltage shifting circuit;

a first switch configured to open and close between the input terminal of the amplifier circuit and an output terminal of the amplifier circuit;

a second switch configured to open and close between the output terminal of the amplifier circuit and an output circuit node of the impedance conversion circuit; and a third switch configured to open and close between the output circuit node of the impedance conversion circuit and the output circuit node of the amplitude expansion circuit.

* * * * *